US011835892B2

(12) United States Patent
Kuge et al.

(10) Patent No.: US 11,835,892 B2
(45) Date of Patent: Dec. 5, 2023

(54) IMAGE FORMING APPARATUS INCLUDING HEATER WITH MOVABLE SHIELD

(71) Applicant: FUJIFILM Business Innovation Corp., Tokyo (JP)

(72) Inventors: Hideki Kuge, Ebina (JP); Norio Ogawahara, Ebina (JP); Kouichi Kimura, Ebina (JP); Mitsutoshi Hongo, Ebina (JP)

(73) Assignee: FUJIFILM BUSINESS INNOVATION CORP., Tokyo (JP)

( * ) Notice: Subject to any disclaimer, the term of this patent is extended or adjusted under 35 U.S.C. 154(b) by 0 days.

(21) Appl. No.: 17/529,867

(22) Filed: Nov. 18, 2021

(65) Prior Publication Data

US 2022/0075298 A1 Mar. 10, 2022

Related U.S. Application Data

(63) Continuation of application No. PCT/JP2020/019871, filed on May 20, 2020.

(30) Foreign Application Priority Data

Jul. 2, 2019 (JP) ..... 2019-123948

(51) Int. Cl.
*G03G 15/20* (2006.01)

(52) U.S. Cl.
CPC ..... *G03G 15/2017* (2013.01); *G03G 15/2007* (2013.01); *G03G 15/2021* (2013.01)

(58) Field of Classification Search
CPC ..... G03G 15/2017; G03G 15/2007; G03G 15/2021; G03G 15/657; G03G 2215/00413

(Continued)

(56) References Cited

U.S. PATENT DOCUMENTS 5,887,238 A * 3/1999 Matsuzoe ..... G03G 15/1625 219/388
6,085,060 A * 7/2000 Goldmann ..... G03G 15/2007 399/68

(Continued)

FOREIGN PATENT DOCUMENTS

JP 2003-075977 A 3/2003
JP 2003-076184 A 3/2003

(Continued)

OTHER PUBLICATIONS

Jun. 16, 2020 International Search Repoert issued in International application No. PCT/JP2020/019871.

(Continued)

*Primary Examiner* — Robert B Beatty
(74) *Attorney, Agent, or Firm* — Oliff PLC

(57) ABSTRACT

An image forming apparatus, includes: an image forming unit that forms a toner image on a medium; a heating unit that is provided on a downstream side in a transport path from the image forming unit and that is configured to heat a medium being transported in a non-contact manner; a fixing unit that is provided on a downstream side in the transport path from the heating unit and fixes the toner image on the medium; a shielding unit to which force is applied so as to be inform a closed state in which the heating unit is shielded; and an open state forming unit configured to receive power supply to drive the shielding unit so as to form an open state in which the heating unit is opened, and maintain the open state while the power is being supplied.

18 Claims, 16 Drawing Sheets

(58) Field of Classification Search
USPC ..... 399/328, 336, 400
See application file for complete search history.

(56) References Cited

U.S. PATENT DOCUMENTS

| | | | | |
|---|---|---|---|---|
| 6,449,458 | B1 | 9/2002 | Lang et al. | |
| 6,957,035 | B1 * | 10/2005 | Giannetti | G03G 15/2028 399/397 |
| 9,266,348 | B1 | 2/2016 | LeFevre | |
| 2004/0175208 | A1 | 9/2004 | Ichida et al. | |
| 2012/0315061 | A1 * | 12/2012 | Kondo | G03G 15/2017 399/92 |
| 2020/0166877 | A1 * | 5/2020 | Tamura | G03G 15/2053 |
| 2022/0075297 | A1 * | 3/2022 | Hongo | G03G 15/2007 |

FOREIGN PATENT DOCUMENTS

| | | | |
|---|---|---|---|
| JP | 2003-248395 | A | 9/2003 |
| JP | 2006-133317 | A | 5/2006 |
| JP | 2007-328222 | A | 12/2007 |
| JP | 2009-288490 | A | 12/2009 |
| JP | 2009-288491 | A | 12/2009 |
| JP | 2010-078745 | A | 4/2010 |
| JP | 2010-096822 | A | 4/2010 |
| JP | 5217634 | B2 | 6/2013 |

OTHER PUBLICATIONS

Jun. 16, 2020 Written Opinion issued in Internation Application No. PCT/JP2020/019871.
Feb. 16, 2023 Office Action issued in Japanese Patent Application No. 2019-123948.

* cited by examiner

IMAGE FORMING APPARATUS INCLUDING HEATER WITH MOVABLE SHIELD

CROSS-REFERENCE TO RELATED APPLICATIONS

This is a continuation of International Application No. PCT/JP2020/019871 filed on May 20, 2020, and claims priority from Japanese Patent Application No. 2019-123948 filed on Jul. 2, 2019.

BACKGROUND

Technical Field

The present invention relates to an image forming apparatus.

Related Art

JP-A-2003-076184 describes an image forming apparatus. The image forming apparatus includes a shutter capable of opening and closing an image forming unit side opening of a fixing unit, and shutter opening position holding means for holding the shutter at an open position. When the holding by the shutter opening position holding means is released, the shutter moves to a closed position by the own weight thereof regardless of the electric driving force.

In the image forming apparatus of JP-A-2009-288491, a shielding region for shielding radiation from a heating source to a heating region by a shielding portion is changed according to the position of the sheet to be transported in the heating region.

The fixing device of JP-A-2007-328222 includes a rotating body for heating, an infrared source that is disposed to face the rotating body and generates infrared rays, an infrared reflecting member that reflects infrared rays to the rotating body side, and a safety element that detects an abnormal temperature rise. Further, the fixing device includes a shielding member that moves and shields between the rotating body and the infrared source when the rotating drive of the rotating body is stopped.

SUMMARY

Aspects of non-limiting embodiments of the present disclosure relate to an image forming apparatus capable of suppressing heating of image forming means by heating means or fixing means as compared with a case in which non-contact type heating means remain open even when power is cut off.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present invention, there is provided an image forming apparatus, including: an image forming unit that forms a toner image on a medium; a heating unit that is provided on a downstream side in a transport path from the image forming unit and that is configured to heat a medium being transported in a non-contact manner; a fixing unit that is provided on a downstream side in the transport path from the heating unit and fixes the toner image on the medium; a shielding unit to which force is applied so as to be inform a closed state in which the heating unit is shielded; and an open state forming unit configured to receive power supply to drive the shielding unit so as to form an open state in which the heating unit is opened, and maintain the open state while the power is being supplied.

BRIEF DESCRIPTION OF DRAWINGS

Exemplary embodiment(s) of the present invention will be described in detail based on the following figures, wherein:

FIG. 14 is a schematic diagram showing a state in which FIG. 13 is viewed from a side;

FIG. 16 is a schematic diagram showing a state in which FIG. 15 is viewed from a side.

DETAILED DESCRIPTION

First Exemplary Embodiment

Hereinafter, a first exemplary embodiment of the present invention will be described with reference to the drawings.

Figure 1:
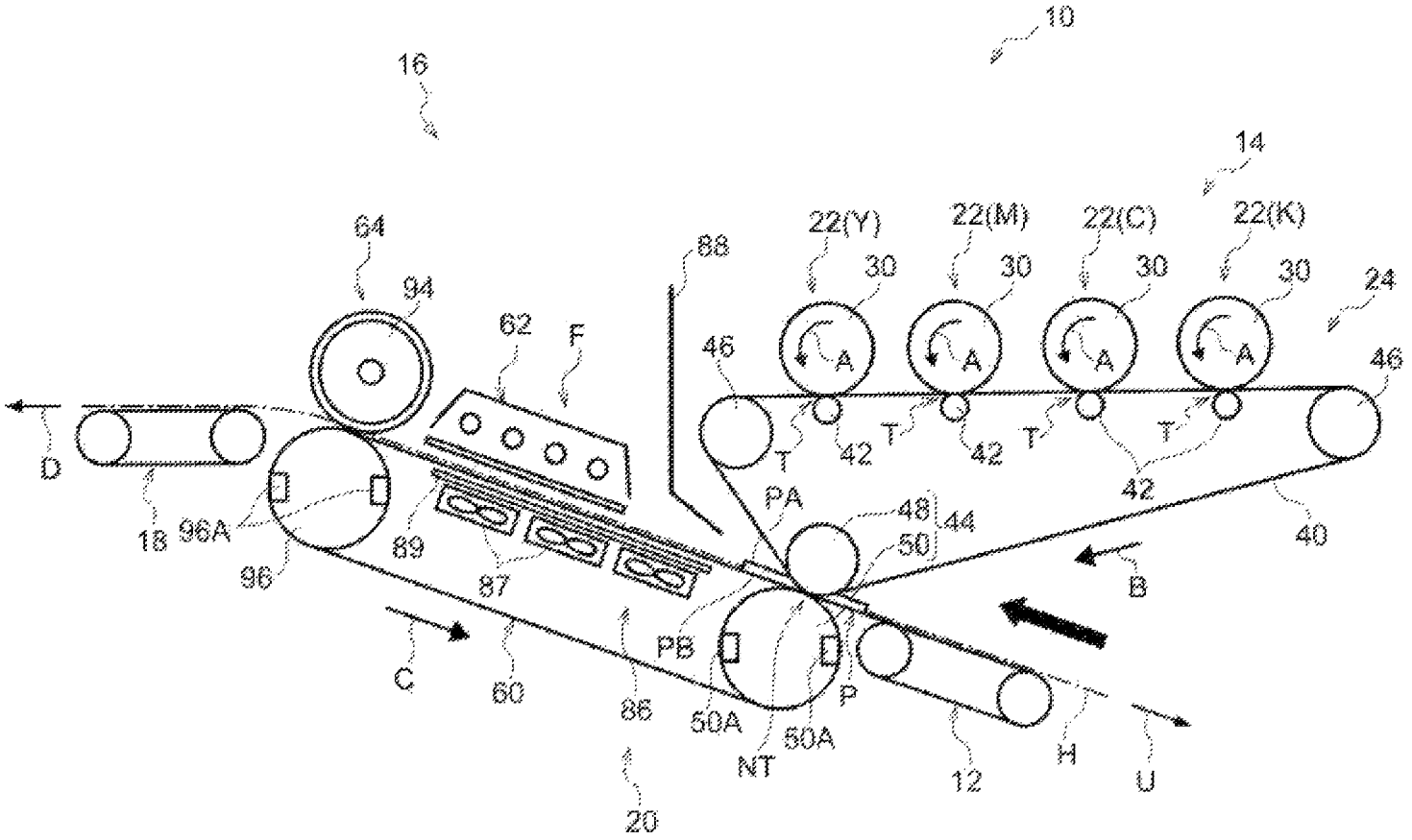
FIG. 1 is a schematic diagram showing a part of an image forming apparatus according to a first exemplary embodiment.

FIG. 1 is a schematic view showing an image forming apparatus 10 according to the present exemplary embodiment. The image forming apparatus 10 is an apparatus that forms an image on a medium P such as a sheet.

The image forming apparatus 10 includes an image forming unit 14 that forms a toner image on a medium P sent from an accommodating unit (not shown) via a feeding-transport unit 12, and a fixing device 16 that fixes the toner image formed on the medium P by the image forming unit 14. The medium P to which the toner image is fixed is discharged from a discharge unit (not shown) via a discharging-transport unit 18. The image forming apparatus 10 further includes a transport mechanism 20 that transports the medium P between the feeding-transport unit 12 and the discharging-transport unit 18.

(Image Forming Unit)

The image forming unit 14 has a function of forming a toner image on the medium P. The image forming unit 14 includes a toner image forming unit 22 that forms a toner image, and a transfer device 24 that transfers the toner image formed by the toner image forming unit 22 to the medium P.

<Toner Image Forming Unit>

The toner image forming unit 22 forms a toner image for each color, and includes toner image forming units 22(Y), 22(M), 22(C), and 22(K) of four colors of yellow (Y), magenta (M), cyan (C), and black (K). The toner image forming unit 22 of each color is basically configured in the same manner except for the toner to be used.

Figure 2:
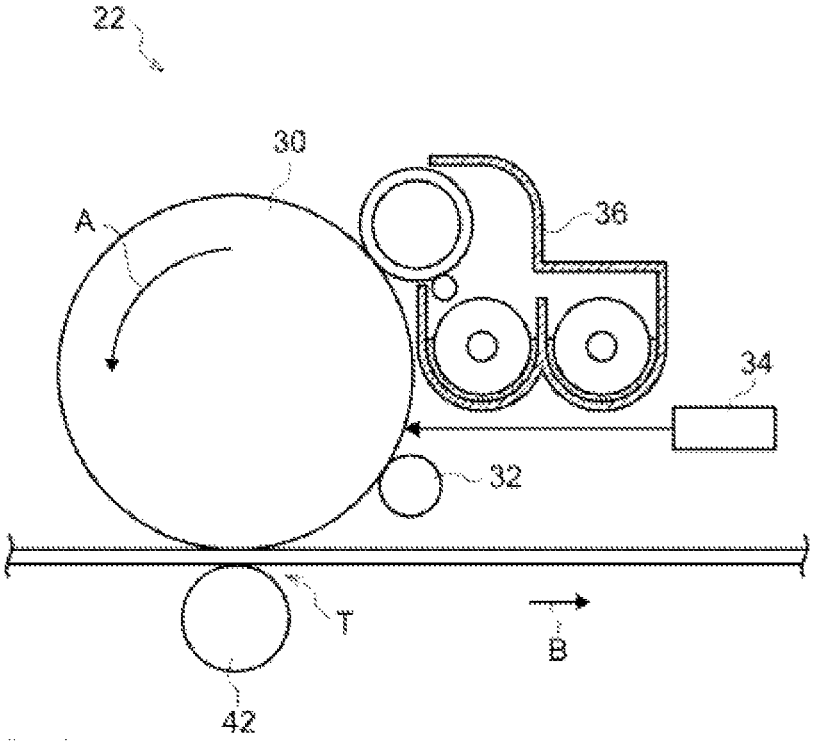
FIG. 2 is a schematic diagram showing a toner image forming unit of the image forming apparatus according to the first exemplary embodiment.

As shown in FIG. 2, the toner image forming unit 22 of each color includes a photoconductor drum 30 that rotates in an arrow A direction, and a charging device 32 that charges the photoconductor drum 30. The toner image forming unit 22 of each color includes an exposure device 34 that exposes the photoconductor drum 30 charged by the charging device 32 to form an electrostatic latent image on the photoconductor drum 30. The toner image forming unit 22 of each color further includes a developing device 36 that develops the electrostatic latent image formed on the photoconductor drum 30 by the exposure device 34 to form a toner image.

<Transfer Device>

As shown in FIG. 1, the transfer device 24 has a function of primarily transferring toner images of the photoconductor drums 30 of the respective colors onto an intermediate transfer body in a superimposed manner, and secondarily transferring the superimposed toner images onto the medium P. The transfer device 24 includes a transfer belt 40 as an intermediate transfer body, a primary transfer roller 42, and a transfer unit 44.

The primary transfer roller 42 has a function of transferring the toner image formed on the photoconductor drum 30 to the transfer belt 40 at a primary transfer position T between the photoconductor drum 30 and the primary transfer roller 42. The transfer belt 40 has an endless shape and is wound around plural rollers 46.

The transfer belt 40 has a function of transporting the primarily transferred toner image to a secondary transfer position NT by rotating in an arrow B direction when at least one of the plural rollers 46 is driven to rotate.

The transfer unit 44 has a function of transferring the toner image transferred to the transfer belt 40 to the medium P. The transfer unit 44 includes a secondary transfer unit 48 and a counter roller 50 that are disposed to face each other. The transfer belt 40 is disposed between the secondary transfer unit 48 and the counter roller 50. A recessed portion 50A configured to accommodate a gripper 68 to be described later is formed on an outer peripheral surface of the counter roller 50.

The transfer unit 44 transfers the toner image transferred to the transfer belt 40 to the medium P passing through the secondary transfer position NT by electrostatic force generated by the discharging of the secondary transfer unit 48.

(Transport Mechanism)

The transport mechanism 20 is disposed between the feeding-transport unit 12 and the discharging-transport unit 18. The transport mechanism 20 has a function of receiving the medium P from the feeding-transport unit 12 with the chain gripper 60. The transport mechanism 20 has a function of delivering the received medium P to the discharge-transport unit 18 via the second transfer position NT, the heating unit 62, and a fixing unit 64.

<Chain Gripper>

Figure 3:
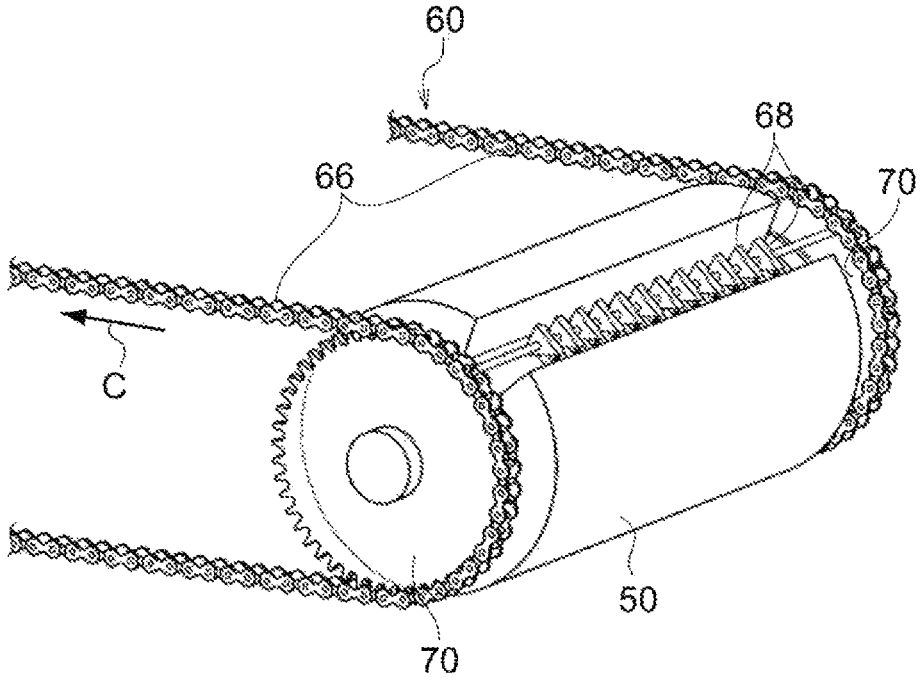
FIG. 3 is an explanatory view showing a state in which a gripper according to the first exemplary embodiment is accommodated in a recessed portion of a counter roller.
Figure 4:
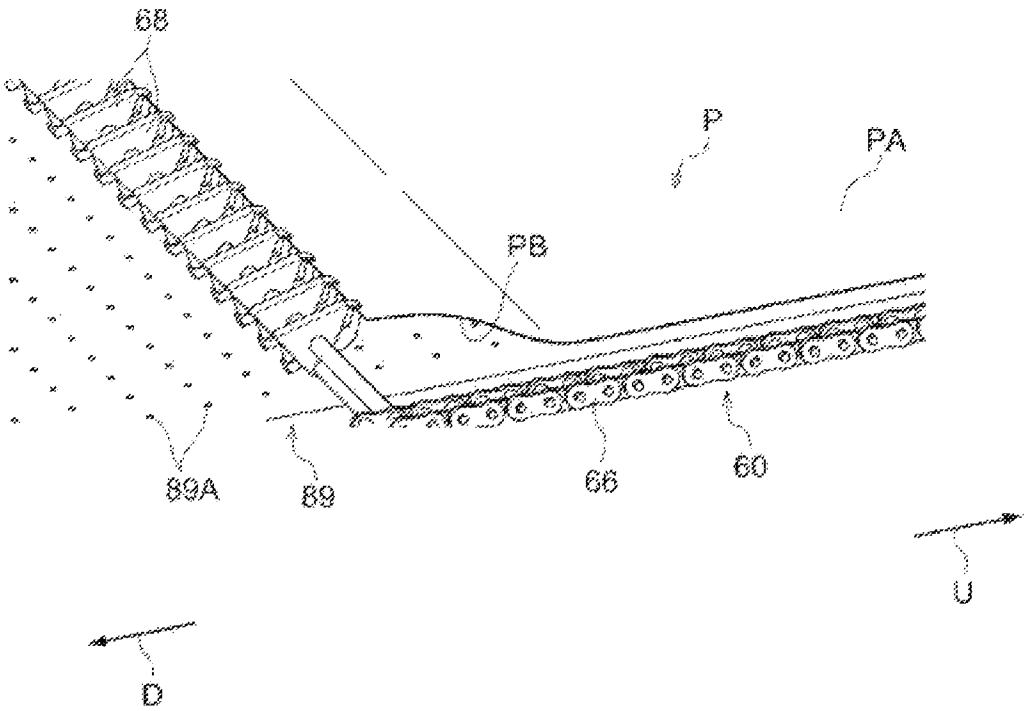
FIG. 4 is an explanatory view showing a state in which a medium is transported by a chain gripper according to the first exemplary embodiment.

As shown in FIG. 3, the chain gripper 60 includes a pair of endless chains 66 that are separated from each other and a gripper 68 that is provided between the two chains 66, and the gripper 68 holds a distal end portion of the medium P on a downstream side D in the medium transport direction as shown in FIG. 4.

As shown in FIG. 3, each of the chains 66 is wound around a sprocket 70 provided at both ends of the counter roller 50 and sprockets provided at both ends of a pressure roller 96 described later.

The chain gripper 60 rotates in an arrow C direction when either one of the two sprockets 70 is rotated, and transports the medium P held by the gripper 68 through the secondary transfer position NT, the heating unit 62, the fixing unit 64, and the discharging-transport unit 18 in this order as shown in FIG. 1.

(Fixing Device)

The fixing device 16 has a function of fixing the toner image formed on the medium P by the image forming unit 14.

The fixing device 16 includes a heating unit 62 provided on the downstream side D in the medium transport direction of the transport path H from the image forming unit 14 and configured to heat the transported medium P in a non-contact manner, and a fixing unit 64 provided on the downstream side D in the medium transport direction from the heating unit 62 and configured to fix the toner image on the medium P. A region of the transport path H heated by the heating unit 62 is an upward gradient that increases from the upstream side U in the medium transport direction toward the downstream side D in the medium transport direction.

Figure 5:
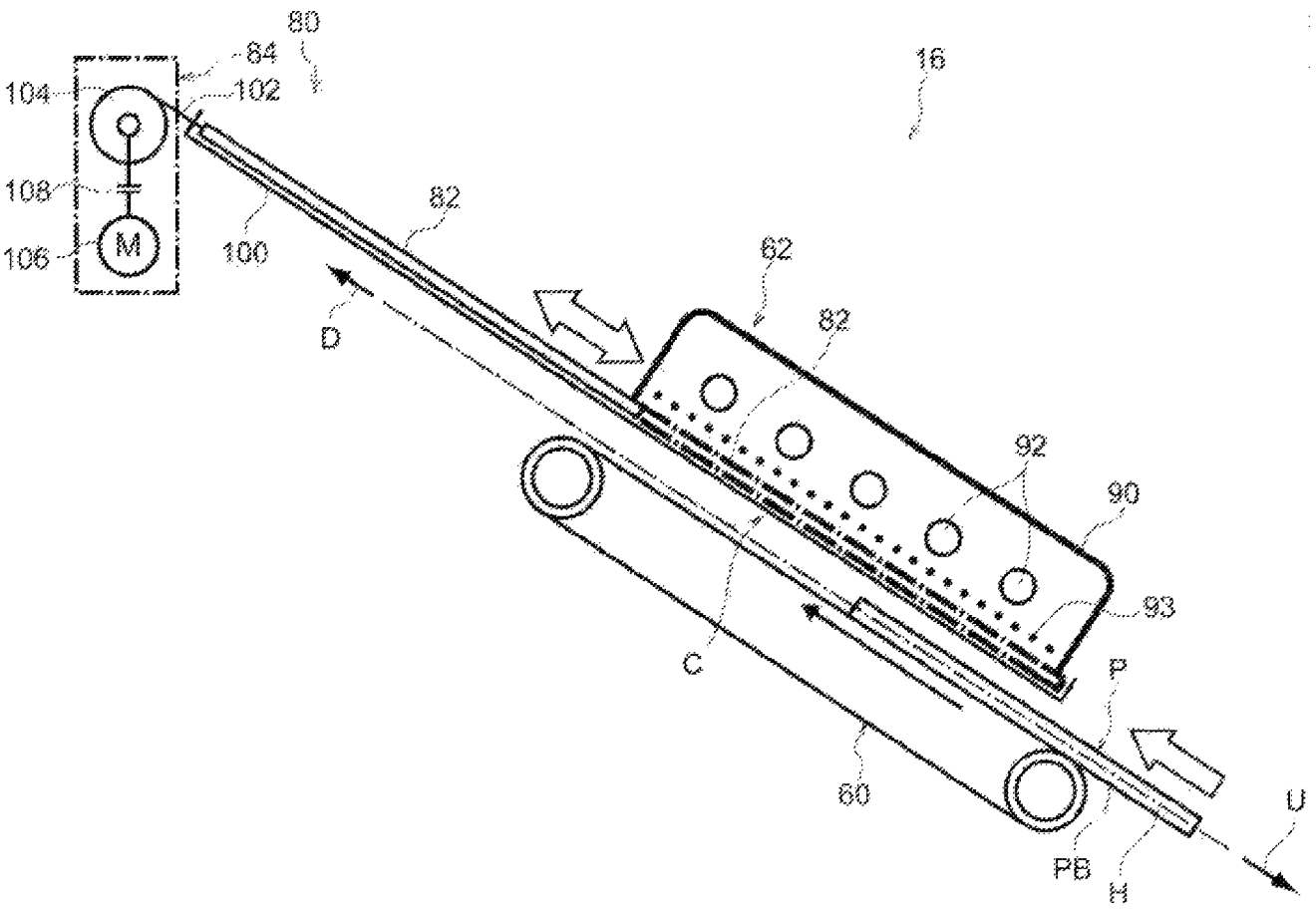
FIG. 5 is an enlarged view showing a portion F in FIG. 1.

As shown in FIG. 5, the fixing device 16 includes a restricting mechanism 80 that restricts release of radiation heat from the heating unit 62. The restricting mechanism 80 includes a shielding unit 82 to which force is applied so as to be in a closed state C in which the heating unit 62 is shielded. Further, the restricting mechanism 80 includes an open state forming unit 84 that receives power supply to drive the shielding unit 82 to form the open state O in which the heating unit 62 is opened, and maintains the open state O while the power is being supplied.

As shown in FIG. 1, the fixing device 16 further includes a blowing unit 86 that blows air toward a back surface PB of the medium P transported between at least the image forming unit 14 and the heating unit 62. A guide plate 88 is disposed between the heating unit 62 of the fixing device 16 and the image forming unit 14 to guide the air from the blowing unit 86 to the downstream side D in the medium transport direction.

A lower end portion of the guide plate 88 is bent, and the lower end portion thereof is inclined toward the image forming unit 14 side as it goes downward, and is disposed on an end portion of a ventilation plate 89 described later.

The guide plate 88 is made of a metal plate, and the guide plate 88 is made of, for example, an aluminum plate.

<Heating Unit>

The heating unit 62 has a function of melting the toner image of the medium P by heating a surface PA of the medium P transported along the transport path H by the chain gripper 60 by radiation transmission in a non-contact manner. As shown in FIG. 5, the heating unit 62 includes a reflection plate 90, a heating source 92, and a wire mesh 93 (not shown) that covers the heating source 92.

[Reflection Plate]

The reflection plate 90 is formed in a container shape that is open toward a lower side of the apparatus, and has a function of reflecting infrared rays from the heating source 92 toward the lower side of the apparatus. The reflection plate 90 is made of a metal plate, and the reflection plate 90 is made of, for example, an aluminum plate.

[Heating Source]

The heating source 92 includes, for example, plural heaters. Examples of the heaters of the heating source 92 include a columnar infrared heater.

[Wire Mesh]

The wire mesh 93 partitions the inside and the outside of the reflection plate 90. The wire mesh 93 suppresses contact between the medium P transported by the chain gripper 60 and the heating source 92.

<Blowing Unit>

As shown in FIG. 1, the blowing unit 86 includes a blower 87 and a ventilation plate 89.

The blower 87 is disposed inside the chain gripper 60 and below the heating unit 62. The blower 87 blows air to the back surface PB of the medium P transported by the chain gripper 60, and causes the medium P to float.

The ventilation plate 89 is disposed between the blower 87 and the heating unit 62 and on the inner peripheral side of the chain gripper 60. As shown in FIG. 4, the ventilation plate 89 includes plural ventilation holes 89A through which the air from the blower 87 passes toward the back surface PB of the medium P transported by the chain gripper 60. Accordingly, the medium P transported by the chain gripper 60 is caused to float, and the back surface PB of the medium P is brought into a non-contact state relative to the ventilation plate 89.

Further, as shown in FIG. 1, the ventilation plate 89 extends toward the downstream side D in the medium transport direction from an end of the heating unit 62 on the upstream side U in the medium transport direction. In other words, the ventilation plate 89 extends toward the image forming unit 14 side from the end of the heating unit 62 on the upstream side U in the medium transport direction. Accordingly, the air passing through the ventilation holes 89A of the ventilation plate 89 is blown toward the back surface PB of the medium P transported between the image forming unit 14 and the heating unit 62.

<Fixing Unit>

The fixing unit 64 includes a heating roller 94 and a pressure roller 96. The fixing unit 64 has a function of fixing the toner image to the medium P by heating and pressurizing the medium P in contact with the medium P.

[Heating Roller]

The heating roller 94 has a built-in heating source, comes into contact with the surface PA of the medium P transported by the chain gripper 60 to heat the medium P, and fixes the toner image to the medium P.

[Pressure Roller]

The pressure roller 96 has a function of pressurizing the medium P by sandwiching the medium P between the pressure roller 96 and the heating roller 94. A recessed portion 96A configured to accommodate the gripper 68 is formed in the outer peripheral surface of the pressure roller 96.

<Restricting Mechanism>

As shown in FIG. 5, the restricting mechanism 80 includes a shielding unit 82 that shields the heating unit 62, and an open state forming unit 84 that opens the shielding unit 82.

[Shielding Unit]

The shielding unit 82 is formed of a plate material having a size that covers and shields the heating unit 62, and the shielding unit 82 constitutes a single shielding portion. Both side portions of the shielding unit 82 are movably supported by rails 100 extending along the transport path H.

The rail 100 extends from the heating unit 62 side to the fixing unit 64 side, and the shielding unit 82 forms a closed state C in which the shielding unit 82 shields the heating unit 62 when the shielding unit 82 moves toward the upstream side U in the medium transport direction along the rails 100. Thereby, the release of heat from the heating unit 62 is suppressed. In other words, heat released downward from the heating unit 62 is restricted. When the shielding unit 82 moves to the downstream side D in the medium transport direction along the rails 100, the shielding unit 82 forms an open state O in which the heating unit 62 is opened. As a result, heat is allowed to be released downward from the heating unit 62.

The rail 100 is inclined so as to rise from the upstream side U in the medium transport direction toward the downstream side D in the medium transport direction. In other words, the rail 100 is inclined so as to rise from the image forming unit 14 side toward the fixing unit 64 side. As a result, force is applied to the shielding unit 82 to move to the upstream side U in the medium transport direction due to the own weight thereof, and force to form the closed state C in which the heating unit 62 is shielded is constantly applied to the shielding unit 82.

[Open State Forming Unit]

The open state forming unit 84 is provided on the downstream side D in the medium transport direction from the heating unit 62. The open state forming unit 84 includes a winding-up roll 104 that winds up a wire 102 extending from downstream side D in the medium transport direction of the shielding unit 82 so as to be able to be drawn out, and a motor 106 that rotates the winding-up roll 104 in a winding up direction. Further, the open state forming unit 84 includes an electromagnetic clutch 108 that connects or disconnects the motor 106 and the rotation mechanism of the winding-up roll 104.

The motor 106 receives power supply and rotates the winding roll 104 in the winding-up direction, thereby driving the shielding unit 82 to the downstream side D in the medium transport direction to form an open state O in which the heating unit 62 is opened. The motor 106 suppresses unexpected rotation of the winding-up roll 104 due to the idling torque of the motor 106.

The electromagnetic clutch 108 connects the motor 106 to the rotation mechanism of the winding-up roll 104 while the electromagnetic clutch 108 is powered on, and the rotation of the winding-up roll 104 is regulated by the idle torque (self-locking of the gear) of the motor 106.

When the power supply is cut off and the electromagnetic clutch 108 is turned off, the electromagnetic clutch 108 releases the connection between the motor 106 and the rotation mechanism of the winding-up roll 104. Therefore, when the power supply is cut off due to a power failure or the like and the electromagnetic clutch 108 is turned off, the winding-up roll 104 becomes rotatable, and the shielding unit 82 moves to the downstream side D in the medium transport direction due to the own weight thereof, so that the closed state C in which the heating unit 62 is shielded is formed.

(Operation and Effects)

The operation of the present exemplary embodiment according to the above configuration will be described.

As compared with the case in which the heat transfer from the non-contact type heating unit 62 is continued when the power supply is cut off due to a power failure or the like, it is possible to suppress the heating of the image forming unit 14 by the heating unit 62 or the fixing unit 64.

In addition, it is possible to suppress the heating of the facing portion such as the blowing unit 86 and the chain gripper 60 facing the heating unit 62.

As a specific example, since the heating unit 62 is shielded by the shielding unit 82, it is possible to suppress the heat of the heating unit 62 from being transferred to the image forming unit 14. In addition, since the distance between the fixing unit 64 and the image forming unit 14 is long, it is possible to suppress the heat from the fixing unit 64 from being transferred to the image forming unit 14.

A region of the transport path H heated by the heating unit 62 is an upward gradient that increases from the upstream side U in the medium transport direction toward the downstream side D in the medium transport direction. In other words, the region of the transport path H heated by the heating unit 62 is an upward gradient that increases from the image forming unit 14 side toward the fixing unit 64 side. Therefore, as compared with a case in which the region of the transport path H is lowered from the upstream side U in the medium transport direction toward the downstream side D in the medium transport direction, the movement of the air that is warmed and rises is suppressed moving to the upstream side U in the medium transport direction.

The blowing unit 86 blows air toward the back surface PB of the medium P transported between the image forming unit 14 and the heating unit 62. Therefore, as compared with the case in which the blowing unit 86 is provided only in the region facing the heating unit 62, it is possible to prevent the air warmed by the heating unit 62 from moving toward the image forming unit 14 side by blowing air from the blowing unit 86.

A guide plate 88 that guides the air from the blowing unit 86 to the downstream side D in the medium transport direction is disposed between the heating unit 62 and the image forming unit 14. Therefore, as compared with the case where the guide plate 88 guides the air to the upstream side U in the medium transport direction, it is possible to promote the movement of the air warmed by the heating unit 62 toward the heating unit 62 side.

The shielding unit 82 is composed of a single shielding portion. Therefore, even in the open state O, it is possible to increase the heating efficiency in the open state O as compared with a case in which a part of the plural shielding portions disposed along the heating surface shields the heating portion.

Second Exemplary Embodiment

Figure 6:
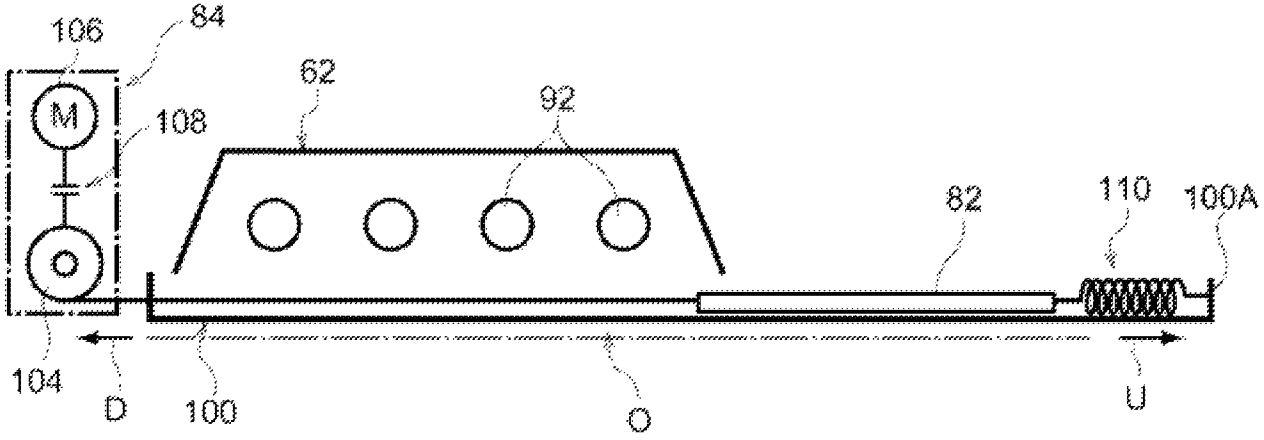
FIG. 6 is a schematic view showing an open state in which the heating unit of a second exemplary embodiment is opened, and is a view corresponding to the F portion in FIG. 1.
Figure 7:
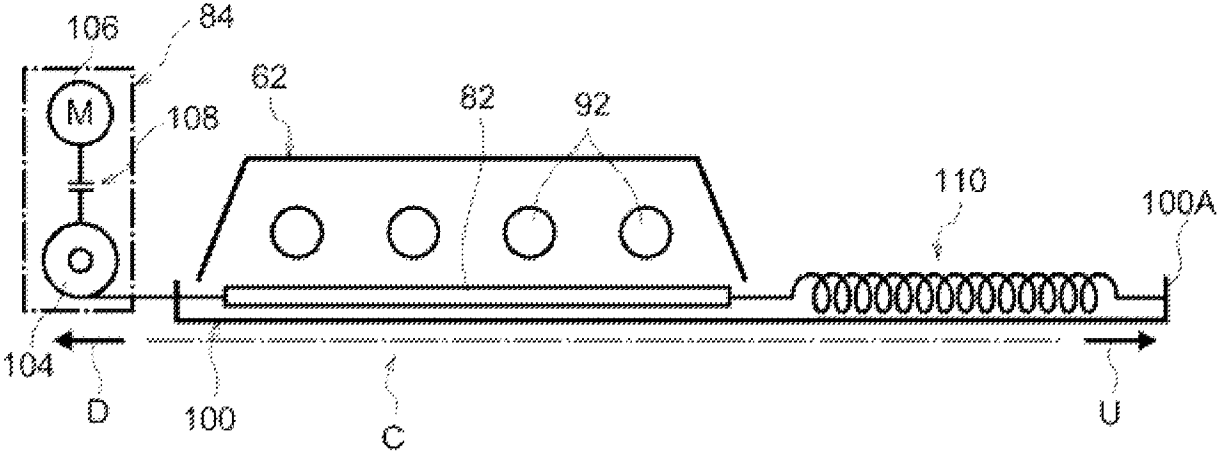
FIG. 7 is a schematic view showing a closed state in which the heating unit of the second exemplary embodiment is shielded, and is a view corresponding to the F portion in FIG. 1.

FIGS. 6 and 7 are views showing a second exemplary embodiment, in which the same or equivalent portions as those of the first exemplary embodiment are denoted by the same reference numerals, description thereof is omitted, and different portions will be described. The second exemplary embodiment differs from the first exemplary embodiment mainly in the region of the transport path H heated by the heating unit 62 and the moving direction of the shielding unit 82.

That is, the region of the transport path H heated by the heating unit 62 is formed substantially horizontally, and the rail 100 that guides the shielding unit 82 extends substantially horizontally.

The rail 100 extends from the heating unit 2 side to the image forming unit 14 side. As shown in FIG. 6, when the shielding unit 82 moves to the upstream side U in the medium transport direction along the rail 100, the shielding unit 82 forms an open state O in which the heating unit 62 is opened.

Further, as shown in FIG. 7, when the shielding unit 82 moves to the downstream side D in the medium transport direction along the rail 100, the shielding unit 82 forms a closed state C in which the heating unit 62 is shielded. In this manner, the shielding unit 82 operates in a direction for shielding from a side close to the image forming unit 14 to form the closed state C.

One end of a coil spring 110 is fixed to an end face 100A of the rail 100 on the upstream side U in the medium transport direction, and the other end of the coil spring 110 is fixed to an end portion of the shielding unit 82 on the upstream side U in the medium transport direction. As a result, the shielding unit 82 is pulled toward the upstream side U in the medium transport direction by the coil spring 110, so that force is constantly applied to the shielding unit 82 so as to be in the closed state C in which the heating unit 62 is shielded.

(Operation and Effects)

In the present exemplary embodiment having the above-described configuration, the same operation and effects as those of the first exemplary embodiment may be obtained for the same or equivalent portions as those of the first exemplary embodiment.

In addition, the shielding unit 82 operates in the direction for shielding from a side close to the image forming unit 14 to form the closed state C. Therefore, as compared with the case of shielding from the side close to the fixing unit 64, it may be possible to suppress the heating of the image forming unit 14 by the heat from the heating unit 62.

Third Exemplary Embodiment

FIGS. 8 to 12 are views showing a third exemplary embodiment, in which the same or equivalent portions as those of the first exemplary embodiment and the second exemplary embodiment are denoted by the same reference numerals, description thereof is omitted, and different portions will be described. The third exemplary embodiment differs from the above-described exemplary embodiments mainly in the shielding unit 82.

Figure 8:
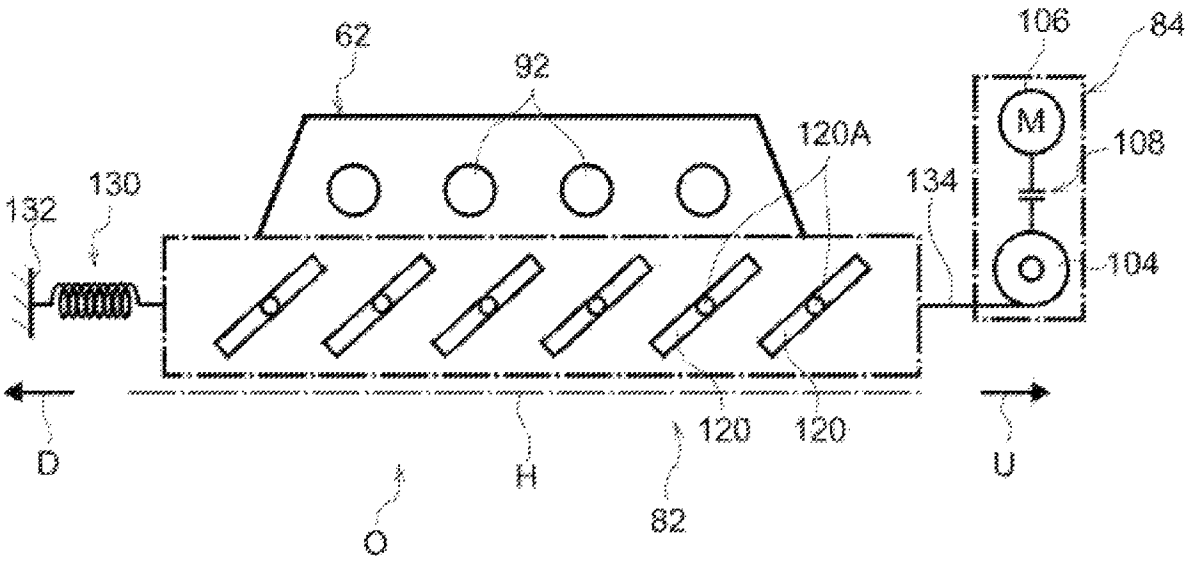
FIG. 8 is a schematic view showing an open state in which the heating unit of a third exemplary embodiment is opened, and a view corresponding to the F portion in FIG. 1.
Figure 9:
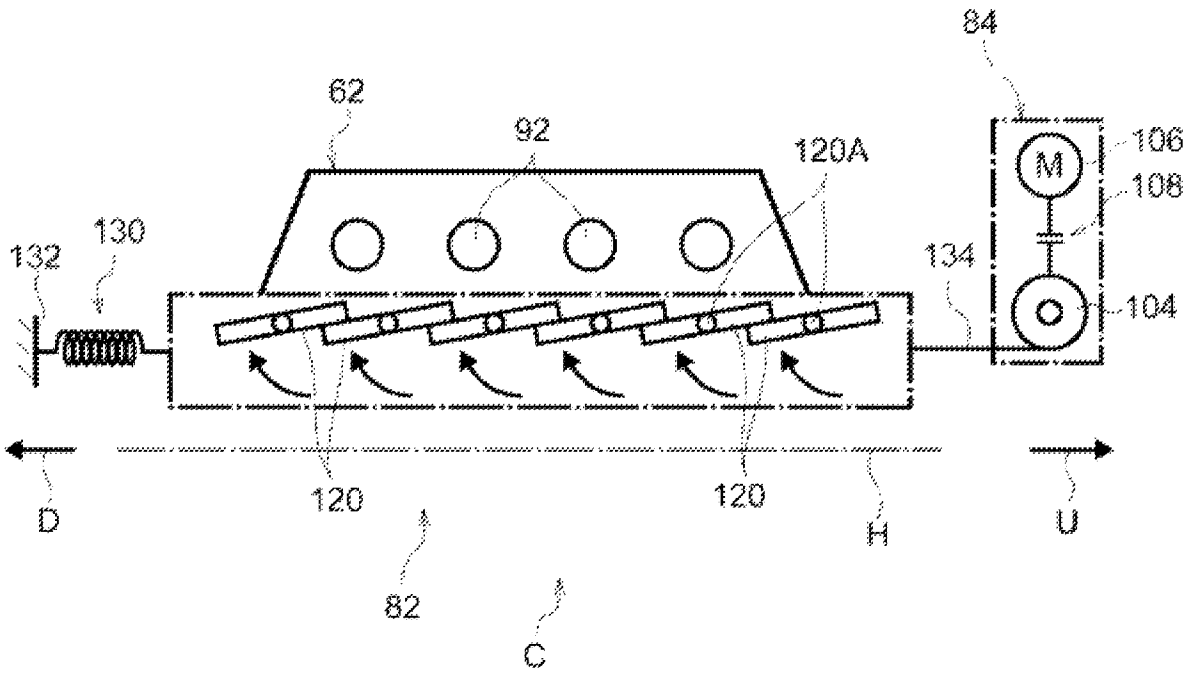
FIG. 9 is a schematic view showing a closed state in which the heating unit of the third exemplary embodiment is shielded, and is a view corresponding to the F portion in FIG. 1.

That is, as shown in FIGS. 8 and 9, the shielding unit 82 includes plural shielding plates 120 disposed in the length direction of the heating unit 62 along the transport path H. Each of the shielding plates 120 is formed in a rectangular shape is long in the width direction of the heating unit 62, and a rotation shaft 120A extending in the length direction is provided in the central portion in the width direction.

Each of the shielding plates 120 is rotatably supported by a bracket (not shown) for rotating a rotation shaft 120A, and each of the shielding plates 120 is supported so as to be rotatable about the rotation shaft 120A.

Figure 10:
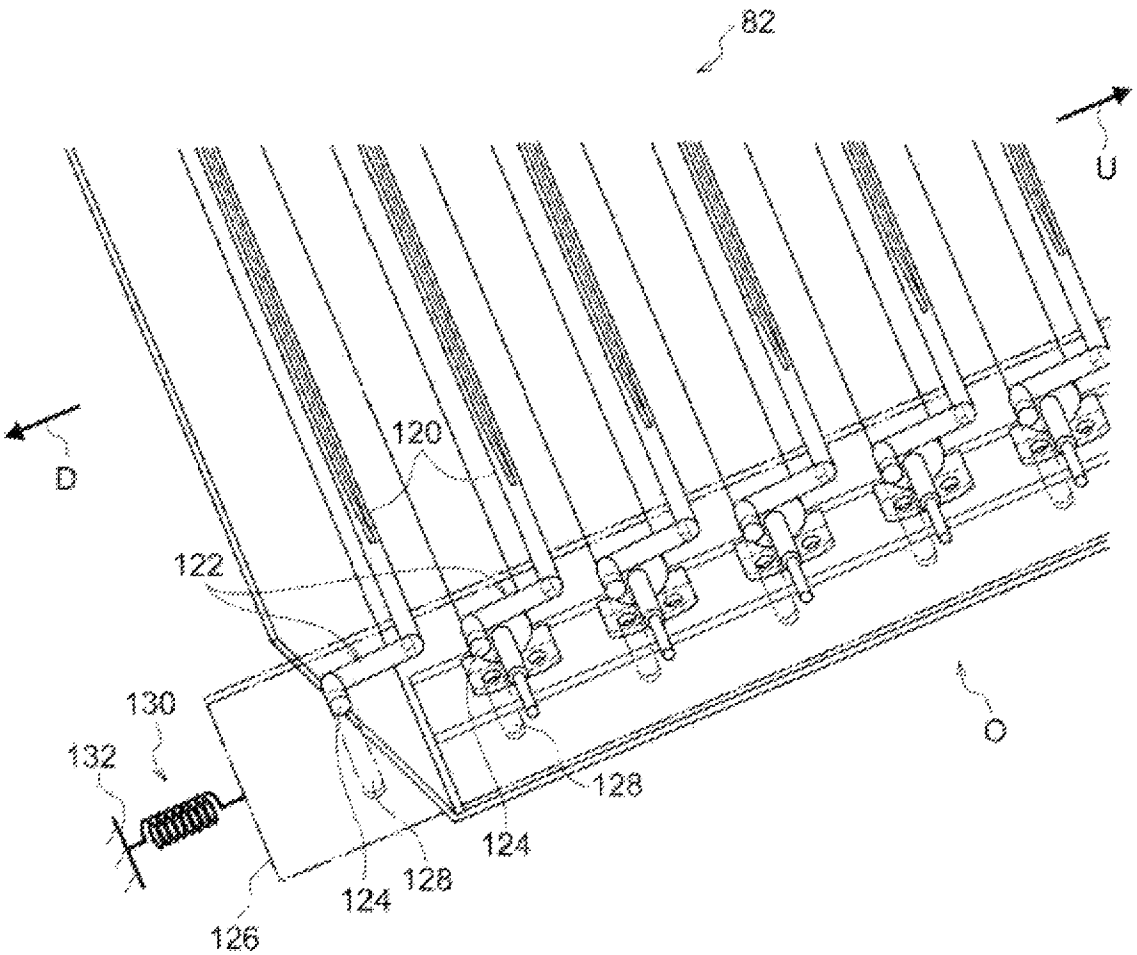
FIG. 10 is a perspective view of a part showing an open state in which the heating unit of the third exemplary embodiment is opened.
Figure 11:
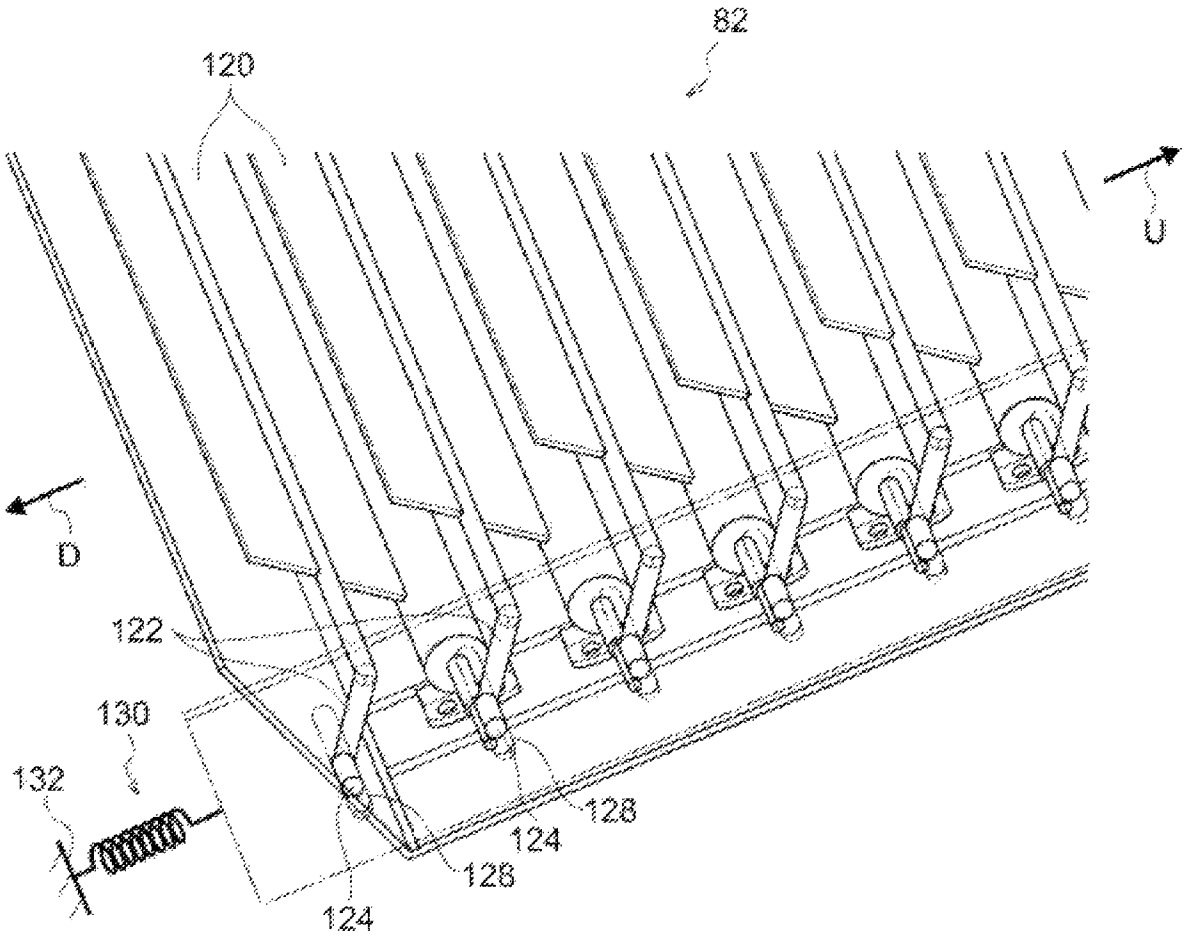
FIG. 11 is a perspective view of a part showing a process in which the heating unit of the third exemplary embodiment is shielded.
Figure 12:
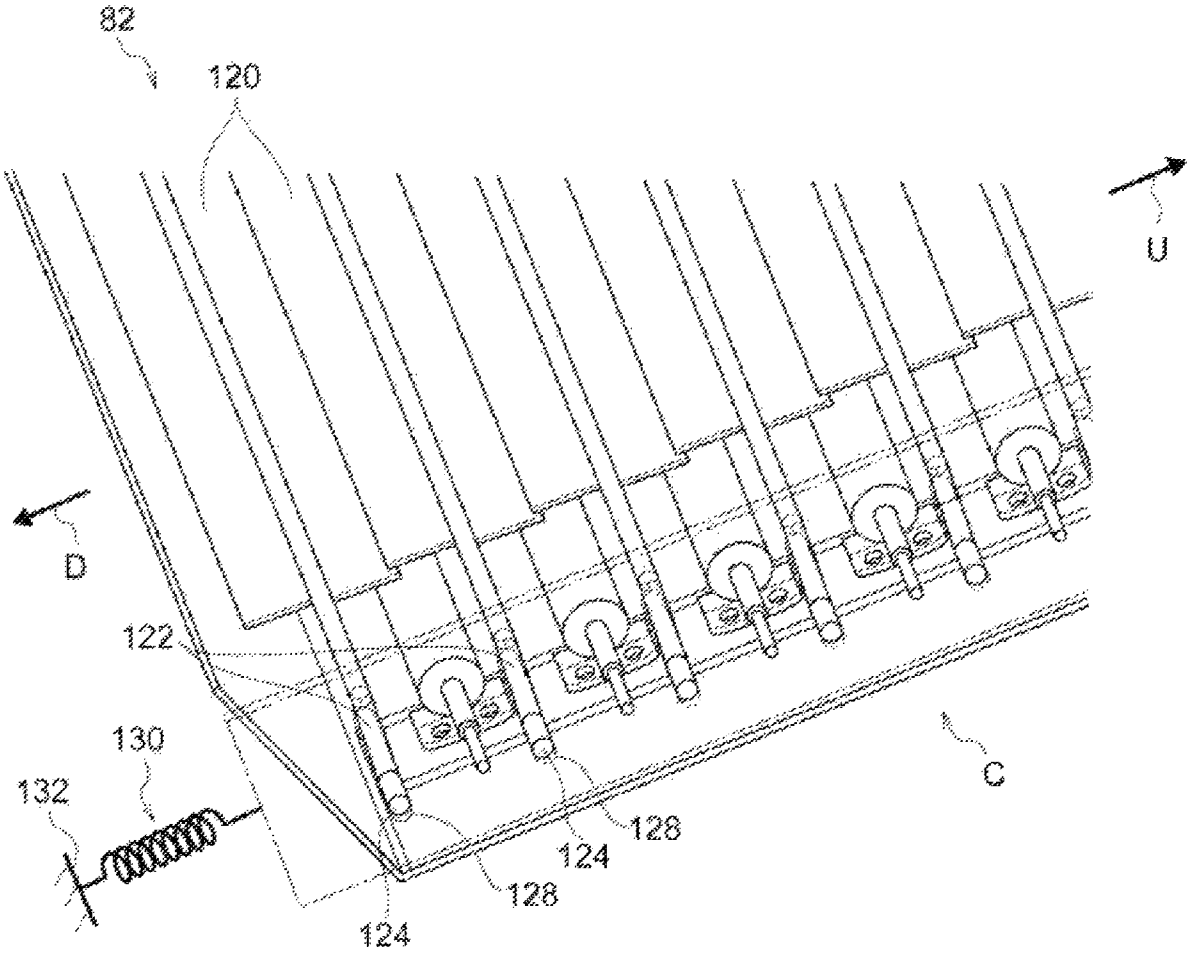
FIG. 12 is a perspective view of a part showing a closed state in which the heating unit of the third exemplary embodiment is shielded.

As shown in FIGS. 10 to 12, an L-shaped crank portion 122 is formed at an end portion of each rotation shaft 120A, and an operation portion 124 protruding laterally is formed at a distal end of the crank portion 122. A rectangular actuation plate 126 extending in the arrangement direction of the shield plates 120 is disposed on an end portion side of each of the shielding plates 120. A long hole 128 into which the operation portion 124 of the crank portion 122 of each corresponding shielding plate 120 is movably inserted is formed in the actuation plate 126.

One end of the coil spring 130 is fixed to an end portion of the operation plate 126 on the downstream side D in the medium transport direction, and the other end of the coil spring 130 is fixed to a housing 132 of the apparatus main body. Accordingly, as shown in FIGS. 9 and 12, force is constantly applied to the actuation plate 126 by the coil spring 130 so that each of the shielding plates 120 of the shielding unit 82 is in the closed state C in which the heating unit 62 is shielded.

As shown in FIGS. 8 and 9, a wire 134 extending from the open state forming unit 84 is fixed to an end portion of the actuation plate 126 on the upstream side U in the medium transport direction. Accordingly, by winding up the wire 134 by the winding-up roll 104 of the open state forming unit 84, as shown in FIGS. 8 and 10, the open state O in which the heating unit 62 is opened may be formed and the opening state O may be maintained.

At this time, each of the shielding plates 120 of the shielding unit 82 operates in the direction for shielding from a side close to the image forming unit 14 to form a closed state.

(Operation and Effects)

In the present exemplary embodiment having the above-described configuration, the same operation and effects as those of the first exemplary embodiment and the second exemplary embodiment may be obtained for the same or equivalent portions as those of the first exemplary embodiment and the second exemplary embodiment.

In addition, by configuring the shielding unit 82 with the plural shielding plates 120 disposed at the lower portion of the heating unit 62, it is possible to suppress an avoidance space of the shielding unit 82 in the open state O as compared with a case in which a single shielding unit 82 having a size covering the heating unit 62 is used.

Fourth Exemplary Embodiment

FIGS. 13 to 16 are views showing a fourth exemplary embodiment, in which the same or equivalent portions as those of the first exemplary embodiment to the third exemplary embodiment are denoted by the same reference numerals, description thereof will be omitted, and different portions will be described. The fourth exemplary embodiment differs from the above-described exemplary embodiments mainly in the restricting mechanism 80 that constitutes the open state forming unit.

Figure 14:
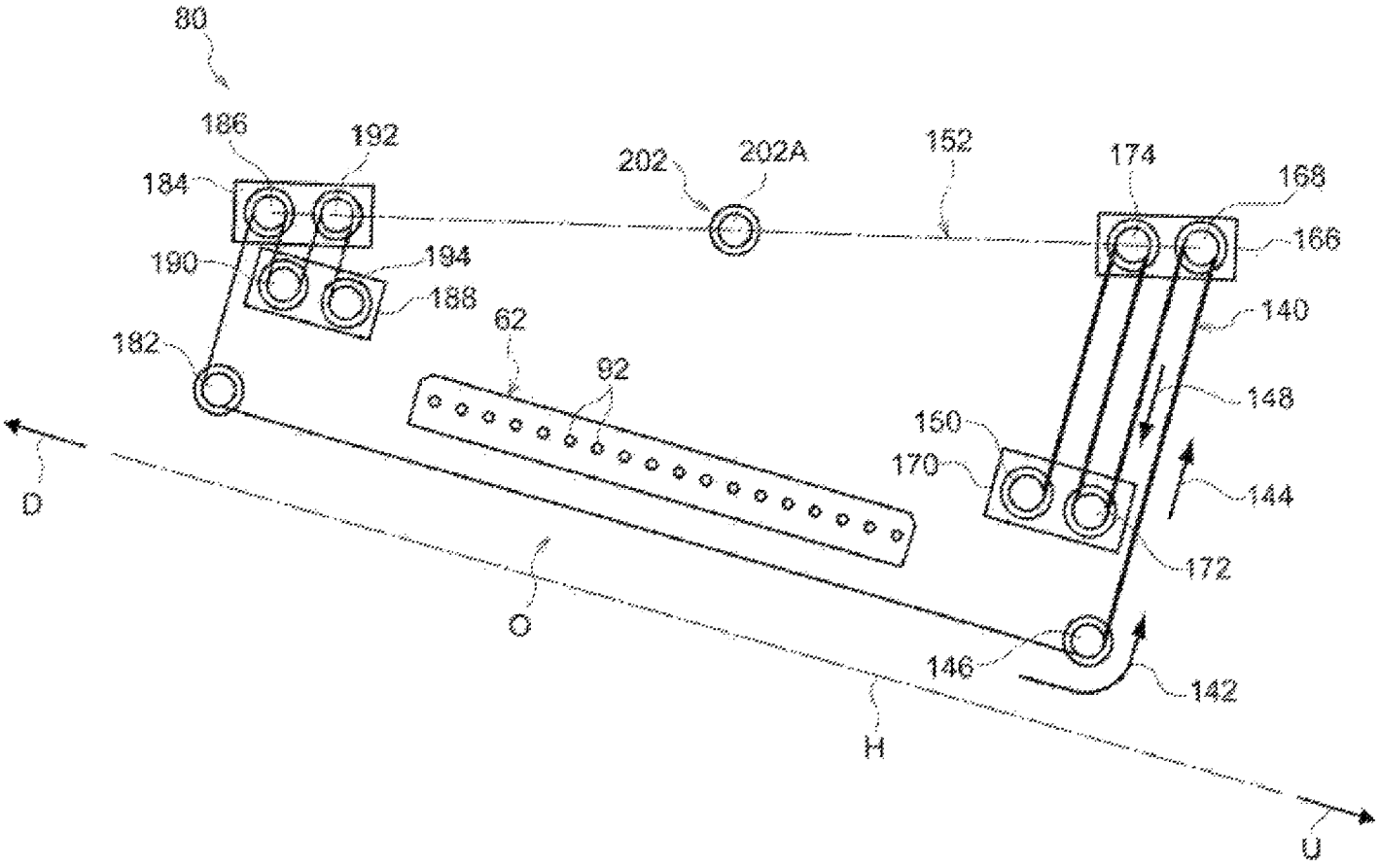

The restricting mechanism 80 includes a shielding unit 82, and the shielding unit 82 includes a shutter 140 movable along the heating unit 62. The restricting mechanism 80 is capable of opening the shutter 140. Further, as shown in FIG. 14, the restricting mechanism 80 includes a changing roller 146 as a changing unit that changes the retracting direction 142 of the shutter 140 in the open state O to a separating direction 144 away from the transport path H, on the upstream side U in the medium transport direction.

The restricting mechanism 80 includes a folding unit (an upstream side first folding roll 168 and an upstream side second folding roll 174 described later) that folds the shutter 140 that moves in the separating direction 144 in the approaching direction 148 approaching the transport path H, and a fixing bar 150 that is a fixing unit that fixes the end portion side of the shutter 140 folded by the folding unit on the transport path H side with respect to the folding unit. In addition, the restricting mechanism 80 includes a moving unit 152 that moves the folding unit in the separating direction.

Figure 13:
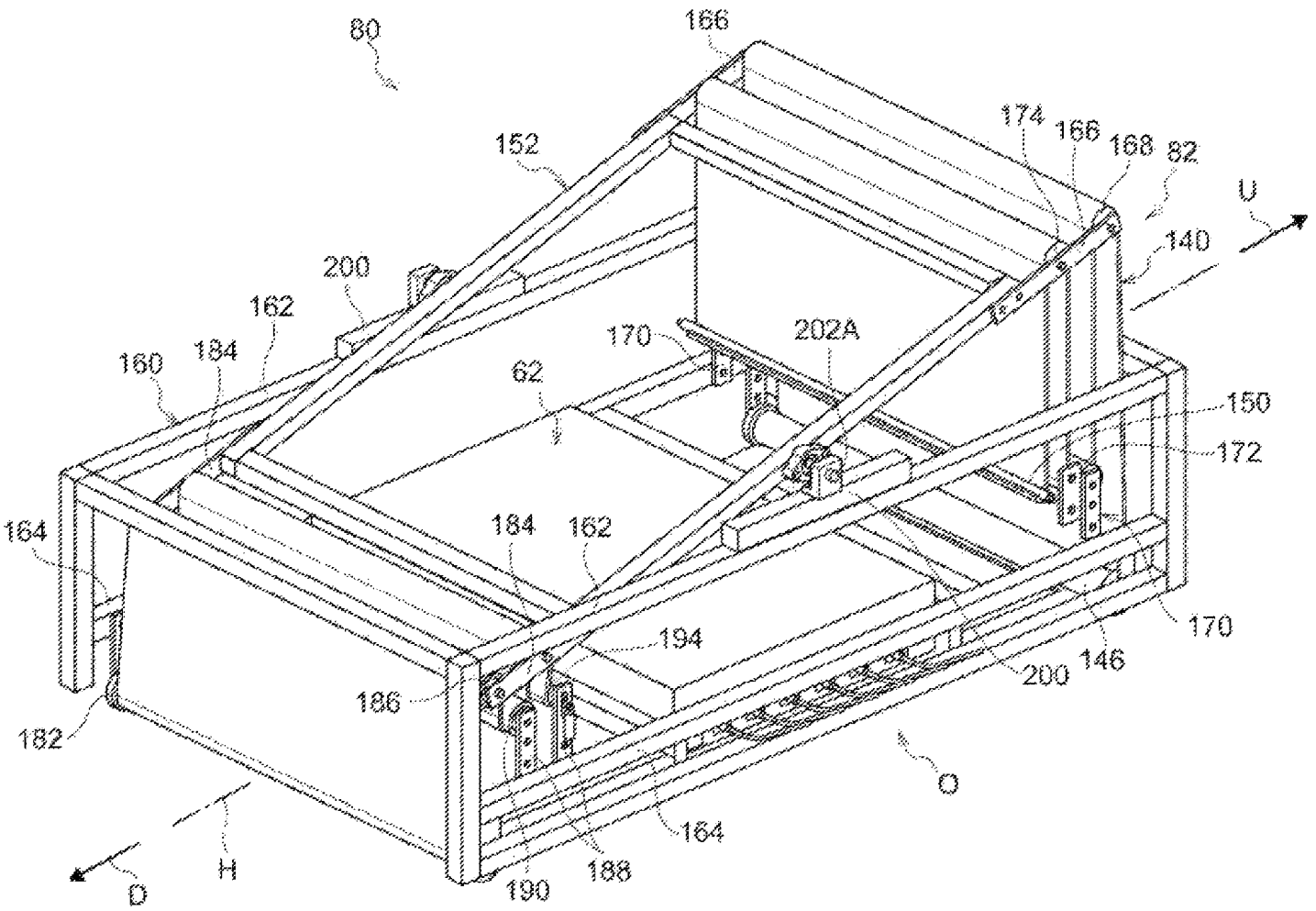
FIG. 13 is a schematic view showing an open state in which the heating unit is opened by the opening/closing mechanism according to a fourth exemplary embodiment, and is a view corresponding to the F portion in FIG. 1.

Specifically, as shown in FIG. 13, the restricting mechanism 80 includes a rectangular frame 160 formed to cover the heating unit 62. Both side edges of an upper portion of the rectangular frame 160 are composed of a pair of upper bridge members 162 extending along the transport path H, and the lower portions of the upper bridge members 162 are provided with a pair of middle bridge members 164 extending along the transport path H.

A changing roll 146 that is a changing unit is rotatably supported on the upstream side U in the medium transport direction between the middle bridge members 164.

The shutter 140, of which the retracting direction 142 is changed to the separating direction 144 by the changing roller 146, is folded back toward the approaching direction 148 by the upstream side first folding roll 168 that is the upstream side first folding unit between the upstream side extension brackets 166 extending from the moving unit 152.

The shutter 140 folded back by the upstream side first folding roll 168 is folded back toward the separating direction 144 by the upstream side folding roll 172 between the upstream side rising brackets 170 extending from the middle bridge members 164 of the rectangular frame 160. Note that the upstream side folding roll 172 and the upstream side second folding roll 174 described later may not be provided.

The shutter 140 folded back by the upstream side folding roll 172 is folded back toward the approaching direction 148 by the upstream side second folding roll 174 that is the upstream side second folding unit between the upstream side extension brackets 166.

One end of the shutter 140 folded back by the upstream side second folding roll 174 is fixed to the fixing bar 150 that is a fixing unit between the upstream side rising brackets 170.

Figure 15:
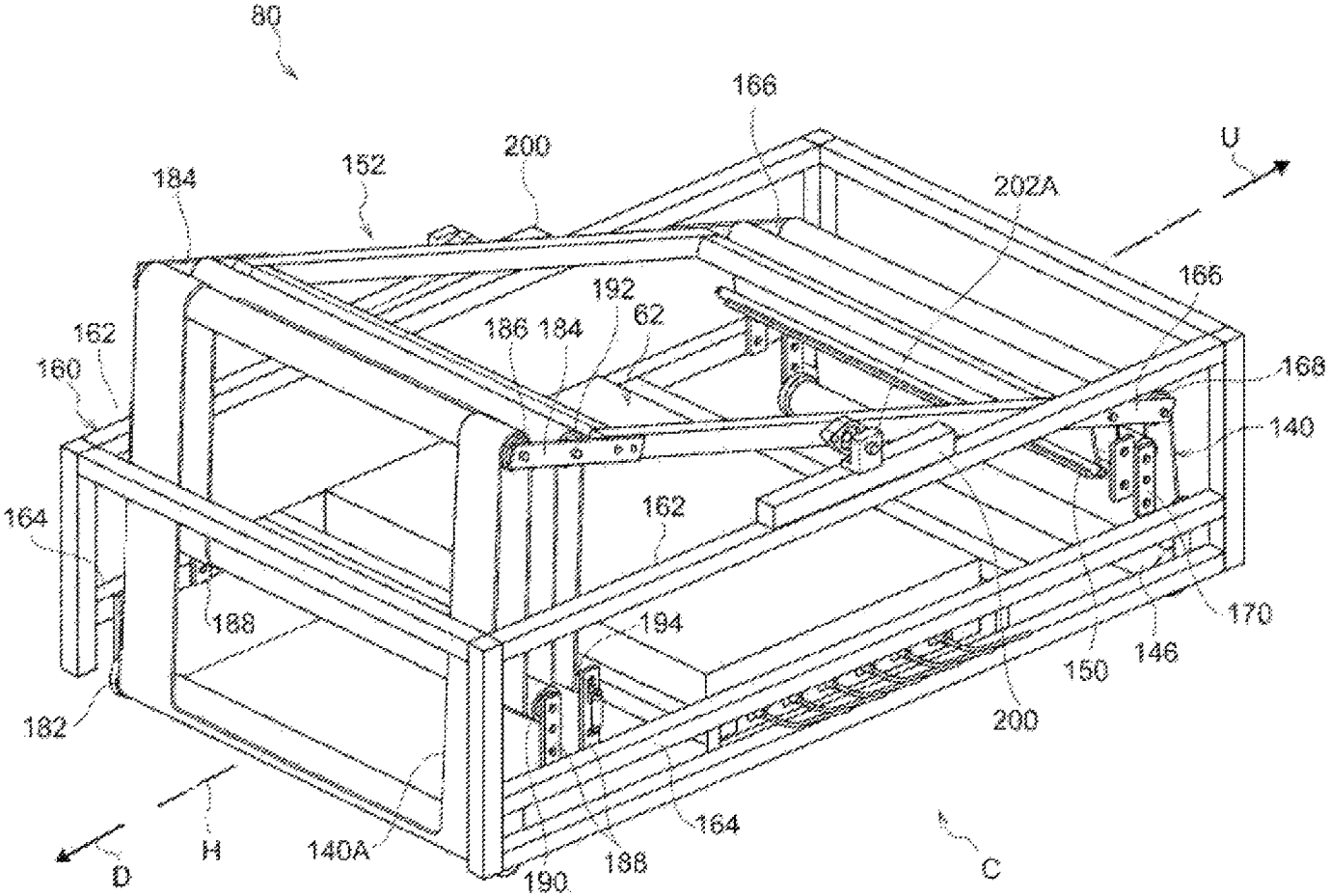
FIG. 15 is a schematic view showing a closed state in which the heating unit is shielded by the opening/closing mechanism according to the fourth exemplary embodiment, and is a view corresponding to the F portion in FIG. 1.
Figure 16:
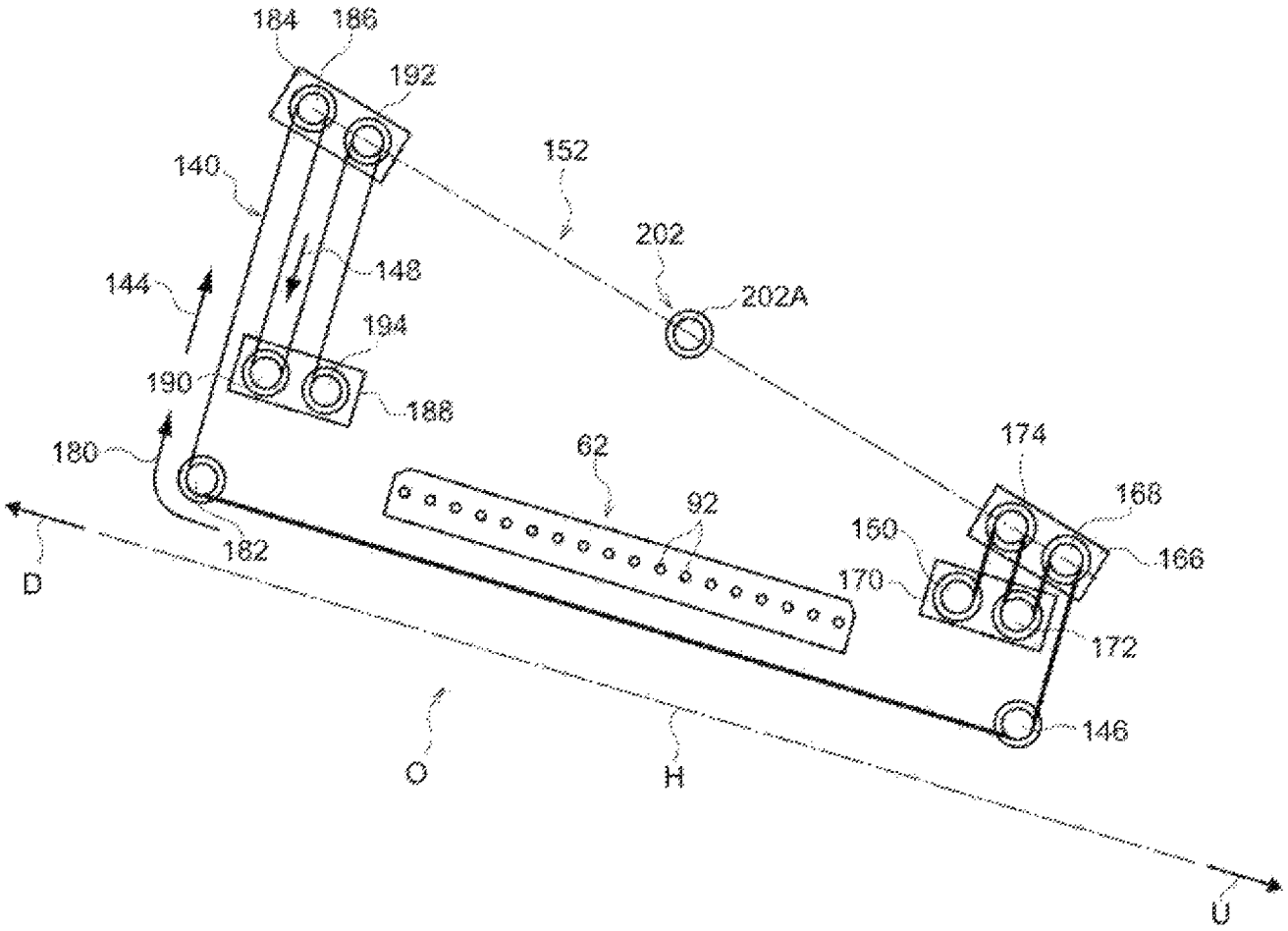

As shown in FIGS. 15 and 16, the restricting mechanism 80 includes a changing roller 182 that changes a tensile direction 180 of the shutter 140 in the closing operation to a separating direction 144 away from the transport path H. The changing roller 182 is provided on the downstream side D in the medium transport direction of each middle bridge member 164.

The shutter 140 in which the tensile direction 180 is changed to the separating direction 144 by the changing roller 182 is folded back toward the approaching direction 148 approaching the transport path H by the downstream side first folding roll 186 between the downstream side extension brackets 184 extending from the moving unit 152.

The shutter 140 folded back by the downstream side first folding roll 186 is folded back toward the separating direction 144 by a downstream side folding roll 190 between the downstream side rising brackets 188 extending from the respective middle bridge members 164 of the rectangular frame 160.

The shutter 140 folded back by the downstream side folding roll 190 is folded back toward the approaching direction 148 by a downstream side second folding roll 192 between the downstream side extension brackets 184.

The other end of the shutter 140 folded back by the downstream side second folding roll 192 is fixed to a fixing bar 194 extending between the two downstream side rising brackets 188.

The shutter 140 is formed in a long sheet shape, and as shown in FIGS. 15 and 16, forms a closed state C in which the heating unit 62 is shielded. A rectangular opening portion 140A (see FIG. 15) is formed in an intermediate portion of the shutter 140, and by disposing the opening portion 140A in a lower portion of the heating unit 62, as shown in FIGS. 13 and 14, an open state O in which the heating unit 62 is opened is formed.

Support members 200 are provided on both upper bridge members 162 of the rectangular frame 160, and a rectangular frame shaped moving unit 152 is supported on a rotation shaft 202A of the clutch motor 202 extending from the support member 200.

Rotation force is applied to the rotation shaft 202A by, for example, a spiral spring, and force is applied such that the moving unit 152 rotates in a direction in which the shutter 140 forms a closed state C in which the heating unit 62 is shielded.

Note that, by adjusting the center of gravity of the moving unit 152, the moving unit 152 may be configured to rotate by the own weight thereof in the direction in which the closed state C is formed.

The clutch motor 202 rotates the moving unit 152 when receiving power supply, and as shown in FIGS. 13 and 14, the upstream side U in the medium transport direction of the moving unit 152 is raised and the rising state is maintained by the idling torque of the motor 202 with the clutch.

Accordingly, a shutter portion including the opening 140A moved to the downstream side D in the medium transport direction of the moving unit 152 is moved to the lower portion of the heating unit 62. At the same time, the shutter portion shielding the heating unit 62 is retracted to the upstream side U in the medium transport direction of the moving unit 152, and the open state O is maintained.

When the power supply is cut off due to a power failure or the like and the clutch of the motor 202 with the clutch is turned off, as shown in FIGS. 15 and 16, the upstream side U in the medium transport direction of the moving unit 152 is lowered. Then, the shutter portion retracted to the upstream side U in the medium transport direction of the moving unit 152 is drawn out to the lower portion of the heating unit 62. At the same time, the shutter portion including the opening portion 140A disposed in the lower portion of the heating unit 62 is moved to the downstream side D in the medium transport direction of the moving unit 152, and the closed state C is formed.

(Operation and Effects)

In the present exemplary embodiment having the above-described configuration, the same operation and effects as those of the first exemplary embodiment to the third exemplary embodiment may be obtained for the same or equivalent portions as those of the first exemplary embodiment to the third exemplary embodiment.

Further, in the present exemplary embodiment, the changing roll 146 is provided as a changing unit that changes the retracting direction 142 of the shutter 140 in the open state O to the separating direction 144 away from the transport path H. Therefore, as compared with the case in which the retracting direction 142 of the shutter 140 is set along the transport path H, it is possible to suppress the dimension of the standby space of the shutter 140 along the transport path H.

The restricting mechanism 80 includes each folding roll 168, 174 that folds the shutter 140 that moves in the separating direction 144 in the approaching direction 148, and a fixing bar 150 that is a fixing unit that fixes the end portion side of the shutter 140 folded by the folding rolls 168, 174. The restricting mechanism 80 also includes a moving unit 152 that moves each of the folding rollers 168, 174 in the separating direction 144. Therefore, it is possible to suppress the dimension of the standby space of the shutter 140 in the direction away from the transport path H as compared with the case in which the folding unit is not provided to fold the shutter 140 moving in the separating direction 144.

In each of the exemplary embodiments described above, the case in which the region of the transport path H heated by the heating unit 62 is the upward gradient or the horizontal from the upstream side U in the medium transport direction toward the downstream side D in the medium transport direction has been described, but the present disclosure is not limited thereto. For example, the region of the transport path H heated by the heating unit 62 may have a downward gradient or may extend in the vertical direction from the upstream side U in the medium transport direction toward the downstream side D in the medium transport direction.

The blower 87 and the ventilation plate 89 may not be provided.

The shielding unit 82 does not necessarily need to shield the wire mesh 93 as long as the shielding unit 82 shields the heating source 92. However, as shown in FIG. 5, in the first exemplary embodiment, the shielding unit 102 forms a closed state in which the heating source 92 and the wire mesh 93 are shielded. Accordingly, in the closed state, the wire mesh 93 heated by the heating source 92 is not exposed. Therefore, workability when the operator performs some work in the vicinity of the chain gripper 60, such as when the operator removes the paper when paper jam occurs, is improved. Further, in the closed state, it is desirable that the dimensions of the shielding unit 82 in the medium transport direction, and the dimension in the direction in which the heating source 92 and the chain gripper 60 face each other and in the direction intersecting the medium transport direction are both larger than those of the wire mesh 93. This is because the wire mesh 93 may be completely shielded in the closed state. In addition, in FIG. 5, the wire mesh 93 is disposed in an inner space, surrounded by the reflecting plate 90, with respect to a position of the reflecting plate 90 that is open toward the lower side of the device. Accordingly, the shielding unit 82 is more likely to shield the wire mesh 93 than in the case in which the wire mesh 93 is disposed below the position opened toward the lower side of the device.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus, comprising:

an image former that forms a toner image on a medium;

a heater that is provided on a downstream side in a transport path from the image former and that is configured to heat the medium being transported in a non-contact manner;

a fixer that is provided on a downstream side in the transport path from the heater and fixes the toner image on the medium;

a shield to which force is applied so as to form a closed state in which the heater is shielded; and an open state former configured to receive power to drive the shield so as to form an open state in which the heater is opened, and maintain the open state while the power is being supplied, wherein the closed state is maintained while the power is off, the shield includes a shutter movable along the heater, the image forming apparatus further comprises a changing roll configured to move the shutter to the open state in a separating direction away from the transport path, and the open state former includes a folding roll that folds the shutter, that is moving in the separating direction, in an approaching direction approaching the transport path, a fixing bar that fixes an end portion side of the shutter at a position closer than the folding roll to the transport path, and a rectangular frame shaped member to which the folding roll is attached and which moves the folding roll in the separating direction.

2. The image forming apparatus according to claim 1, wherein a region of the transport path heated by the heater has an upward gradient from an upstream side in the transport path to the heater to a downstream side in the transport path from the heater.

3. The image forming apparatus according to claim 1, further comprising a blower that blows air toward a back surface of the medium being transported between the image former and the heater.

4. The image forming apparatus according to claim 2, further comprising a blower that blows air toward a back surface of the medium being transported between the image former and the heater.

5. The image forming apparatus according to claim 3, further comprising a guide plate that is disposed between the heater and the image former and that is configured to guide air from the blower to a downstream side in the transport path from the image former.

6. The image forming apparatus according to claim 4, further comprising a guide plate that is disposed between the heater and the image former and that is configured to guide air from the blower to a downstream side in the transport path from the image former.

7. The image forming apparatus according to claim 1, wherein the shield is operated from a side close to the image former such that the closed state in which the heater is shielded is formed from the side close to the image former.

8. The image forming apparatus according to claim 2, wherein the shield is operated from a side close to the image former such that the closed state in which the heater is shielded is formed from the side close to the image former.

9. The image forming apparatus according to claim 3, wherein the shield is operated from a side close to the image former such that the closed state in which the heater is shielded is formed from the side close to the image former.

10. The image forming apparatus according to claim 4, wherein the shield is operated from a side close to the image former such that the closed state in which the heater is shielded is formed from the side close to the image former.

11. The image forming apparatus according to claim 5, wherein the shield is operated from a side close to the image former such that the closed state in which the heater is shielded is formed from the side close to the image former.

12. The image forming apparatus according to claim 6, wherein the shield is operated from a side close to the image former such that the closed state in which the heater is shielded is formed from the side close to the image former.

13. The image forming apparatus according to claim 7, wherein the shield includes a single shielding portion.

14. The image forming apparatus according to claim 8, wherein the shield includes a single shielding portion.

15. The image forming apparatus according to claim 9, wherein the shield includes a single shielding portion.

16. The image forming apparatus according to claim 10, wherein the shield includes a single shielding portion.

17. The image forming apparatus according to claim 11, wherein the shield includes a single shielding portion.

18. The image forming apparatus according to claim 12, wherein the shield includes a single shielding portion.

* * * * *